United States Patent [19]

Handa et al.

[11] 4,368,923

[45] Jan. 18, 1983

[54] NODULE COLLECTOR

[75] Inventors: Keiji Handa, Sakura; Norio Yamakado, Tokyo, both of Japan

[73] Assignee: Director-General of Agency of Industrial Science & Technology, Tokyo, Japan

[21] Appl. No.: 234,463

[22] Filed: Feb. 17, 1981

[51] Int. Cl.[3] ..... E02F 3/94

[52] U.S. Cl. ..... 299/8; 37/DIG. 8

[58] Field of Search ..... 299/8; 37/DIG. 8, 57

[56] References Cited

U.S. PATENT DOCUMENTS

| | | | |
|---|---|---|---|
| 3,988,843 | 11/1976 | Brockett | 37/DIG. 8 |
| 4,042,279 | 8/1977 | Asakawa | 299/8 |
| 4,070,061 | 1/1978 | Obolensky | 299/8 |
| 4,147,390 | 4/1979 | Deliege et al. | 299/8 |
| 4,311,342 | 1/1982 | Latimer | 299/8 |

*Primary Examiner*—Ernest R. Purser

*Attorney, Agent, or Firm*—Stephen F. K. Yee

[57] ABSTRACT

A nodule collector for deep sea mining includes an outer sledge and an inner sledge disposed in and connected to the outer sledge for trailing movement therewith. The inner sledge is provided with a transversely extending cutting blade, a plurality of jet nozzles arranged along the cutting blade, and a longitudinally oriented duct. When the collector travels across the seafloor, the cutting blade cuts into the seafloor and raises it thereover. The water jets from the nozzles impinge upon the summit of the raised seafloor material so that nodules and sediments at the summit are carried away by the water jets and introduced through the duct into a collecting chamber provided in the outer sledge. The collecting chamber has a special design to prevent entrance of undesirably large sized nodules thereinto and residence of undesirably small sized nodules and sediments therein. The nodules collected in the collecting chamber are successively transported up to the mining ship for recovery.

5 Claims, 3 Drawing Figures

NODULE COLLECTOR

BACKGROUND OF THE INVENTION

This invention relates to an apparatus for the recovery of mineral nodules, especially manganese nodules from the seafloor.

An ocean mining system is generally comprised of a mining ship, a riser and a collector vehicle adapted to travel on the seafloor. Nodules which exist on or partly burried in the seafloor sediments are gathered by the collector and are transported to the mining ship through the riser. Since the mining operation is conducted at depths of several thousands meters, the collector is one of the most important components in the mining system. Thus, the collector should have a high collecting efficiency and must be able to continuously and effectively operate for a long period of time. Moreover, the collector should not feed muddy sediments to the riser since otherwise the surface of the ocean would be considerably polluted.

SUMMARY OF THE INVENTION

It is, therefore, an object of the present invention to provide an apparatus which can recover mineral nodules, especially manganese nodules, from the seafloor with a high collecting efficiency and which can operate for a long period of time without encountering troubles.

Another object of the present invention is to provide an apparatus of the above-mentioned type, which can selectively recover nodules of desired sizes from the seafloor.

In accomplishing the foregoing objects, there is provided in accordance with the present invention an apparatus for recovering mineral nodules from the seafloor, including an outer frame having a bottom portion formed into a sledge so that the outer frame can travel on the seafloor, an inner frame disposed within the outer frame and having a bottom portion formed into a sledge, a joint member connecting the front end of the inner frame to a leading end portion of the outer frame so that the inner frame may be trailed by the outer frame, a collecting chamber provided at the trailing end of the outer frame, a transversely oriented cutting blade secured to the inner frame and projected from the bottom of the inner frame so that the seafloor surface may be raised by the cutting blade when the outer frame travels on the seafloor, a longitudinally extending duct provided in the inner frame such that one end thereof opens adjacently to the cutting blade and the other end thereof opens adjacently to the collecting chamber, a plurality of transversely arranged jet nozzles secured to said inner frame and adapted to jet water therefrom, and a pump member mounted on the outer frame for feeding water to the jet nozzles. The collecting chamber, cutting blade and jet nozzles are so arranged that the apex portion of the seafloor raised by the cutting blade can be scoured by the water jetted from the nozzles and introduced into the collecting chamber through the duct.

BRIEF DESCRIPTION OF THE DRAWINGS

Other objects, features and advantages of the present invention will become apparent from the detailed description of preferred embodiments of the present invention which follows, when considered in light of the accompanying drawings, in which.

DESCRIPTION OF THE PREFERRED EMBODIMENTS

Figure 1:
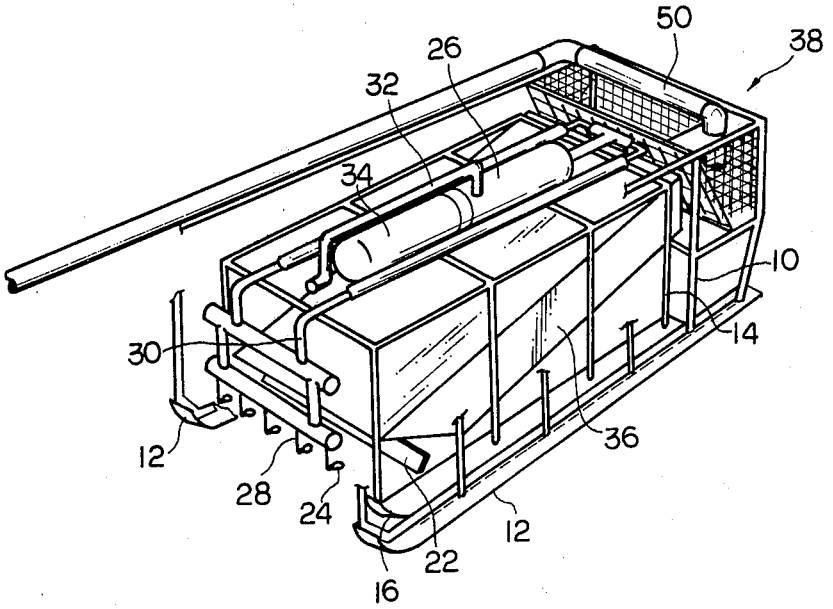
FIG. 1 is a partial perspective view, cut away in part, schematically showing one embodiment of the nodule collector according to the present invention.
Figure 3:
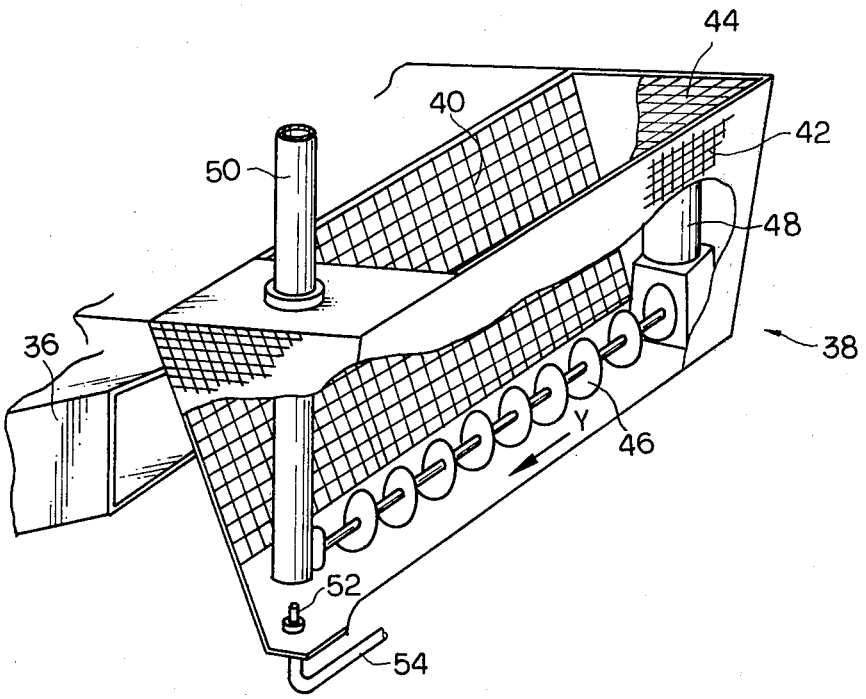
FIG. 3 is a partial perspective view, cut away in part, schematically showing a collecting chamber of the nodule collector of FIG. 1.
Figure 2:
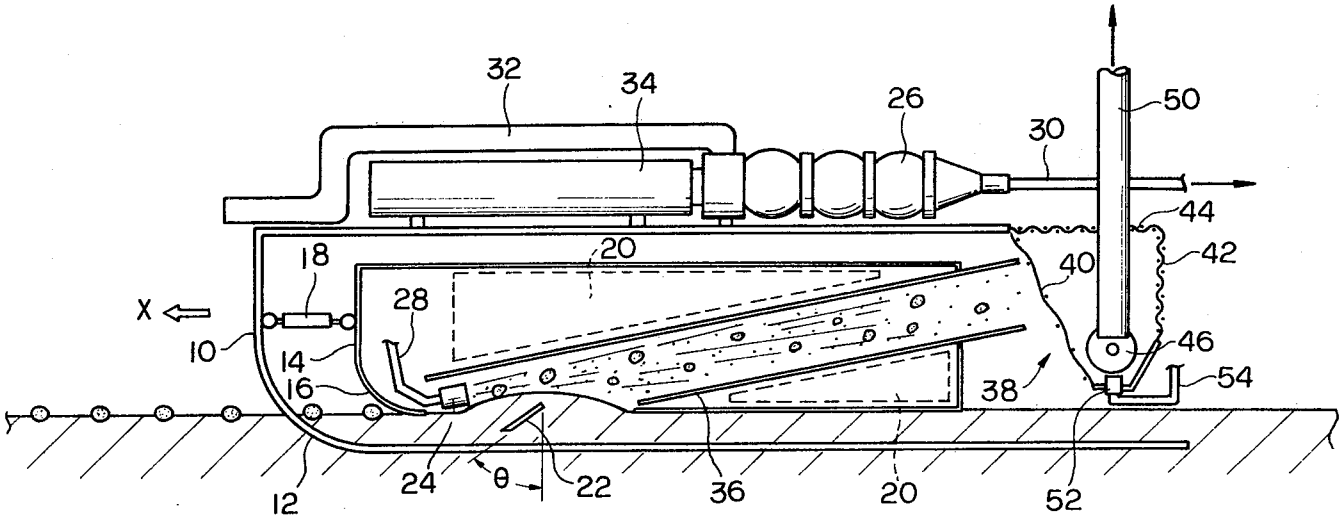
FIG. 2 is an elevational view explanatory of the collector of FIG. 1.

One embodiment of a nodule collector constructed in accordance with the present invention is illustrated in FIGS. 1 through 3, and reference should be had first to FIGS. 1 and 2. The reference numeral 10 denotes an outer frame generally rectangular in shape and having a pair of laterally spaced apart sledges 12 at its underside. Disposed within the outer frame 10 is an inner frame 14 which is also provided with a pair of sledges 16 at its suitable underside portions. As can be seen in FIG. 2, the front end of the inner frame 14 is connected to the leading end of the outer frame 10 by means of a joint member 18, preferably a flexible joint. As a result of this construction, the outer frame 10 can travel on the seafloor with the inner frame 14 being trailed thereby. The inner frame 14 is provided with a buoyant member 20 to control the underside level of the inner frame 14 relative to the surface of the seafloor. Good results are obtained when the underside of the inner frame 14 is maintained in the same level as the seafloor.

A cutting blade 22 extends transversely between opposite sides of the inner frame 14 and is fixed there. As shown in FIG. 2, the cutting blade 22 is protruded from the bottom surface of the inner frame 14 and is oriented such that when the inner frame 14 moves forward, i.e. in the direction shown by the arrow X, the cutting blade 22 can cut into the seafloor and raise it thereover. Preferably, the angle of inclination $\theta$ of the cutting blade 22 is 60° or more.

In front of the cutting blade 22, a plurality of nozzles 24 are located. The nozzles 24 are supported by the inner frame 14 and their heads are generally laterally aligned along the transversely oriented cutting blade 22. The nozzles 24 are adapted to water jets in directions so that the jet water may impinge on the summit of the seafloor surface raised by the cutting blade 22.

Mounted on the outer frame 10 is a pump 26 for feeding water to the nozzles 24. The nozzles 24 are connected to pipes 28 branched from a pipe 30 connected to the exhaust port of the pump 26. The intake port of the pump 26 is connected to a pipe 32 which opens at its free end to the leading end of the outer frame 10. The pump 26 is operated by a driving means 34 mounted on the outer frame 10.

The inner frame 14 has a duct 36 longitudinally disposed therein. As can be seen in FIG. 2, one end of the duct 36 is opened to receive water jet from the nozzles 24 while the other end thereof opens adjacently to a collection chamber 38 formed in the trailing end of the outer frame 10.

In order to miminize the loss in velocity of the jet flow within the duct 36, the duct is oriented in the same direction as that of water jet from the nozzles 24.

One embodiment of the collection chamber 38 is illustrated in FIG. 3. The collection chamber 38 has a front side 40 formed of a net member and serving as oversize rejection screen. The mesh size of the oversize rejection screen 40 is selected so that the screen 40 may prevent passage therethrough of substances whose sizes are larger that a desired upper size, e.g. larger than 80 mm. The opposite side 42 and upper side 44 of the collecting chamber 38 are also formed of a net member and serve as separation screen. The separation screen 42 and 44 has a mesh size finer than the rejection screen 40 and allows passage therethrough of substances having smaller sizes than a desired lower limit, e.g. smaller than 5 mm.

Disposed transversely at the bottom of the collecting chamber 38 is a screw conveyor 46 which is rotatingly driven by a motor 48. By rotation of the screw 46, the nodules collected at the bottom of the collecting chamber 38 are conveyed in the direction indicated by the arrow Y. A riser pipe 50 extends downward into the collecting chamber 38 and terminates near the bottom of the chamber 38. At the bottom of the chamber 38, a nozzle 52 is mounted in vertical alignment with the riser pipe 50. The nozzle 52 is supplied with water from the pump 26 through a connecting pipe 54 branched from the pipe 30. The other end of the riser pipe 50 is connected to a suction pump (not shown) provided on the mining ship. Thus, the nodules conveyed by the screw 46 can be successively introduced into the riser pipe 50 and transported up to the mining ship by the suction force of the pump on the mining ship as well as pushing force of the jet water from the nozzle 52.

In operation, the nodule collector is placed on the seafloor and is towed by the mining ship. Any suitable cable may be used for towing the collector by the mining ship. The riser 50 itself can be used for this purpose. When the nodule collector travels across the seafloor at a predetermined speed, for example at one knot, the outer frame 10 is partly burried in the seafloor by gravity. However, the inner frame 14 can travel on the seafloor with its sledges being in contact with and in parallel with the surface of the seafloor, since the inner frame 14 is provided with the buoyant member 20 and is connected to the outer frame 10 by means of the flexible joint 18. As the collector is advanced, the cutting blade 22 fixed to the inner frame 14 cuts into the seafloor and raises it thereover. By driving the motor 34 of the pump 26, clean sea water is introduced from the intake of the pipe 32 and jetted from the nozzles 24 for impingement with the apex of the raised seafloor at a speed sufficient to carry the nodules into the collecting chamber 38 through the duct 36. The arrangement and the number of the nozzles 24 may be determined so that uniform jet flows are established throughout the duct 36.

Nodules are known to exist partially buried in the clayey seafloor sediment. Since, with the nodule collector according to the present invention, such nodules tend to be exposed on the surface of the seafloor by the raising action of the cutting blade 22, the amount of sediments entrained with the nodules by the scouring action of the jets of water from the nozzles 24 may be minimized.

The nodules and sediments removed from the seafloor move up the inclined duct 36 and substantially all the nodules having diameters smaller than the mesh size of the oversize rejection screen 40 can enter into the collecting chamber 38. Nodules having too large diameters to pass through the screen 40 are directed down onto the seafloor. The sediments introduced into the collecting chamber 38 together with the nodules are allowed to pass through the separation screen 42 provided opposite to the oversize rejection screen 40 and are discharged out of the collection chamber 38. Also nodules having smaller diameters than the mesh size of the separation screen 42 may be discharged from the chamber 38, leaving nodules having selected range of diameters.

The nodules left within the collection chamber 38 are successively displaced transversely by means of the screw conveyor 46 and are introduced into the riser pipe 50 by the jet flow from the nozzle 52 and the suction force from the riser pipe 50 for transportation to the mining ship. On the mining ship, the nodules are separated from the seawater and recovered.

The nodule collector of this invention is very simple in structure and is capable of operating for a long period of time without troubles, such as clogging of riser and entrainment of muddy sediments in the recovered nodules. The combination of jet nozzles and cutting blade may improve the collecting efficiency of the collector and reduce the amount of muddy or silty sediments introduced into the duct.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

We claim:

1. An apparatus for recovering mineral nodules from the seafloor, comprising:

an outer frame having a bottom portion formed into a sledge so that said outer frame can travel on the seafloor;

an inner frame disposed within said outer frame and having a bottom portion formed into a sledge;

a joint member connecting the front end of said inner frame to a leading end portion of said outer frame so that said inner frame may be trailed by said outer frame on the seafloor;

a buoyant member provided on said inner frame to prevent said inner frame sinking into the seafloor;

a collecting chamber provided at the trailing end of said outer frame;

a transversely oriented cutting blade secured to said inner frame and projected from the bottom of said inner frame so that the seafloor surface may be raised by said cutting blade when said outer frame travels on the seafloor;

a longitudinally extending duct provided on said inner frame having one end open adjacent to said cutting blade and the other end open adjacent to said collecting chamber;

a plurality of transversely arranged jet nozzles secured to said inner frame and adapted to jet water therefrom;

said collecting chamber, cutting blade and jet nozzles being so arranged that the summit of the seafloor raised by said cutting blade may be scoured and introduced into said collecting chamber through said duct by water jetted from said nozzles; and a pump member mounted on said outer frame for feeding water to said jet nozzles.

2. An apparatus as set forth in claim 1, wherein said joint member is a flexible joint so that vertical movement of said inner frame is independent from the movement of said outer frame.

3. An apparatus as set forth in claim 1, further comprising a conveyor means provided within said collecting chamber for conveying nodules collected on the bottom of said collecting chamber to a nodule discharge port.

4. An apparatus as set forth in claim 3, further comprising a vertically oriented jet nozzle provided opposite to said discharge port and adapted to jet water therefrom for facilitating discharge of the nodules into said discharge port.

5. An apparatus as set forth in claim 1, wherein said collecting chamber includes a first screen facing the open end of said duct and formed of a first net member, and a second screen arranged opposite to said first screen and formed of a second net member, the mesh size of said first net member being greater than said second net member, said screens cooperating to control the sizes of the recovered nodules.

* * * * *